United States Patent [19]

Kellum

[11] Patent Number: 4,996,861

[45] Date of Patent: Mar. 5, 1991

[54] APPARATUS FOR FORMING AN ELOGATED TUBULAR ELEMENT INTO A HELIX

[75] Inventor: George W. Kellum, Mattapoiset, Mass.

[73] Assignee: Stern/Leach Company, Attleboro, Mass.

[21] Appl. No.: 476,822

[22] Filed: Feb. 8, 1990

[51] Int. Cl.[5] ..... B21F 3/04

[52] U.S. Cl. ..... 72/144; 72/145

[58] Field of Search ..... 72/135, 138, 142, 143, 72/144, 145, 150

[56] References Cited

U.S. PATENT DOCUMENTS

| | | | |
|---|---|---|---|
| Re. 814 | 9/1859 | Perkins et al. | 72/142 X |
| 250,528 | 12/1881 | Hayden | 72/142 |
| 304,639 | 9/1884 | Grimmett et al. | 72/144 |
| 865,803 | 9/1907 | Row | 72/144 X |
| 3,186,820 | 6/1965 | Adkins | 72/144 X |

FOREIGN PATENT DOCUMENTS

| | | | |
|---|---|---|---|
| 2006877 | 4/1979 | Fed. Rep. of Germany | 72/142 |
| 3703317 | 2/1907 | France | 72/144 |
| 871891 | 10/1981 | U.S.S.R. | 72/142 |
| 1275319 | 5/1972 | United Kingdom | 72/144 |

*Primary Examiner*—E. Michael Combs

*Attorney, Agent, or Firm*—Samuels, Gauthier & Stevens

[57] ABSTRACT

The apparatus of the present invention includes an externally threaded spindle to which one end of a thin walled metal tube is detachably secured. The spindle is rotated to wind the tube into the external thread, thereby producing a helix. As the tube is wound onto the spindle, it is pressed into the thread grooves by an auxiliary roller.

17 Claims, 2 Drawing Sheets

APPARATUS FOR FORMING AN ELOGATED TUBULAR ELEMENT INTO A HELIX

BACKGROUND OF THE INVENTION

1. Filed of the Invention

This invention relates generally to the art of metal deformation, and is concerned primarily with the formation of helixes from thin walled metal tubes, particularly those clad with precious metals.

2. Description of the Prior Art

In the manufacture of tubular hoop-shaped earrings and other like jewelry products, elongated straight tubes are conventionally drawn from blanks consisting of a base metal such as brass with a surface layer of a precious metal such as 14 karat gold bonded thereto. Typically, the brass will be approximately 0.004 inches in thickness, and the gold surface layer will be 0.005–0.007 inches thick. The tubes are then manually bent or wrapped around cylindrical mandrels to form helixes. The thus formed helixes are next cut into individual hoops. The hoops are acid etched to remove the base metal, and are then assembled with other components to complete the finished articles.

Prior to being bent into helixes, the tubes are conventionally filled with sand and their ends are pinched shut. The sand is intended to avoid or at least minimize wrinkling and crimping during the manual bending operation. However, experience has indicated that even when the tubes are filled with sand, some wrinkling along the inside surfaces of the hoops is still experienced, thereby resulting in an unacceptably high reject rate. While somewhat beneficial in minimizing wrinkling, the sand becomes the source of other problems during subsequent manufacturing steps. More particularly, when subdividing the helixes into individual hoops, the sand has a deleterious effect on cutting equipment, in particular causing rapid wear and necessitating frequent changes of saw blades. The sand also presents cleaning problems. Failure to effect complete sand removal can adversely effect subsequent etching procedures.

The manual bending operation also results in some "spring back" of the helix convolutions. This in turn adversely affects product uniformity, and in extreme cases can be the cause of further rejects.

Finally, because of the difficulties encountered in manually bending tubes around cylindrical mandrels, this practice has been limited to round cross sectional configurations. Other tube configurations, e.g., ovals, rectangles, etc. have generally been avoided.

A general objective of the present invention is to provide an improved apparatus for forming thin walled metal tubes into helixes.

A more specific objective of the present invention is to provide an apparatus which is capable of bending thin walled tubes into helixes without first filling the tubes with sand, and without accompanying spring back.

Still another objective of the present invention is the provision of an apparatus capable of forming helixes from thin walled tubes of varying cross sections, including rounds, ovals and straight-sided configurations.

SUMMARY OF THE INVENTION

The apparatus of the present invention includes an externally threaded spindle to which one end of the tube to be bent is detachably secured. The spindle is rotated to wind the tube into the external thread, thereby producing a helix. As the tube is wound onto the spindle, it is pressed into the thread grooves by an auxiliary roller.

BRIEF DESCRIPTION OF THE DRAWINGS

An embodiment of the invention will now be described by way of example only, with reference to the accompanying drawings, wherein.

DESCRIPTION OF ILLUSTRATED EMBODIMENT

Figure 1:
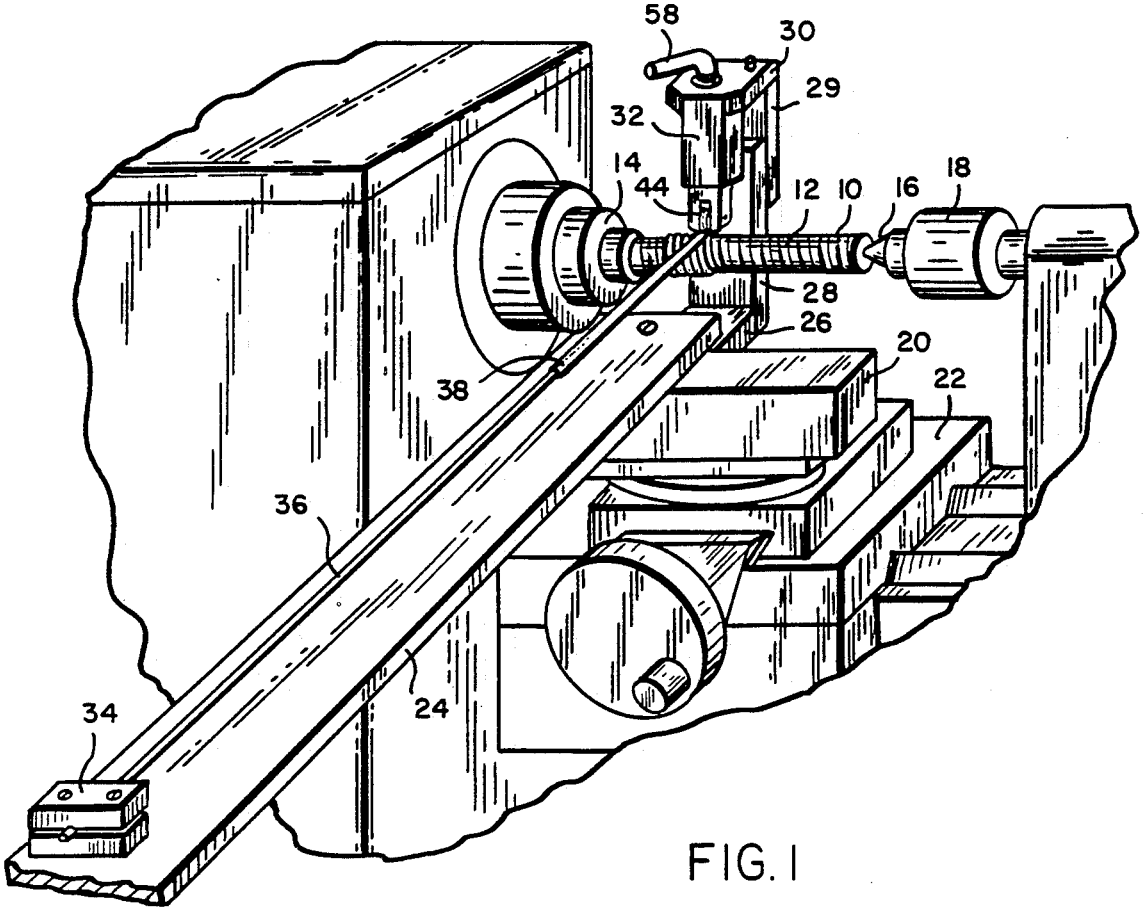
FIG. 1 is a perspective view of an apparatus in accordance with the invention.

The apparatus of the present invention includes a spindle 10 having a spiral groove 12 in the form of a screw thread in its external surface. The spindle may be conveniently mounted in the chuck 14 of a lathe, with the distal end of the spindle being supported by the tapered end 16 of the lathe tail stock 18.

A block 20 is mounted on the lathe cross slide 22, the latter being conventionally driven for movement to and fro along a path parallel to the rotational axis of the spindle 10. An arm 24 is carried by and extends laterally from the block 20 in a direction perpendicular to the spindle 10. A shelf 26 is carried by and extends laterally from the cross slide 22 in the opposite direction. Shelf 26 supports a post 28 to which is secured a second post 29 carrying an L-shaped bracket 30 having a somewhat tubular depending vertical head 22.

Arm 24 carries a clamp 34 holding one end of an elongated wire-like mandrel 36 on which is axially threaded a tube 38 to be formed into a helix. In this case, the tube and mandrel have rectangular cross sectional configurations, but as will hereinafter become apparent, other shapes can also be processed with the apparatus of the present invention. One end of the tube 38 is bent as at 40 into an opening 42 in the spindle 10, it being understood that the opening 42 extends radially inwardly from the base of the groove 12.

The tube 38 is pressed into the groove 12 by a grooved auxiliary roller 44 carried on the bifurcated end of a slide 46 received axially in the tubular head 32. The roller 44 is rotatable about an axis parallel to the axis of spindle 10. The slide has an enlarged collar 48 acted upon both above and below by upper and lower compression springs 50,52. The upper compression spring 50 is in turn acted upon by the enlarged diameter foot 54 of a rod 56 threaded through the upper end of the head 32 and connected to a handle 58.

Figure 2:
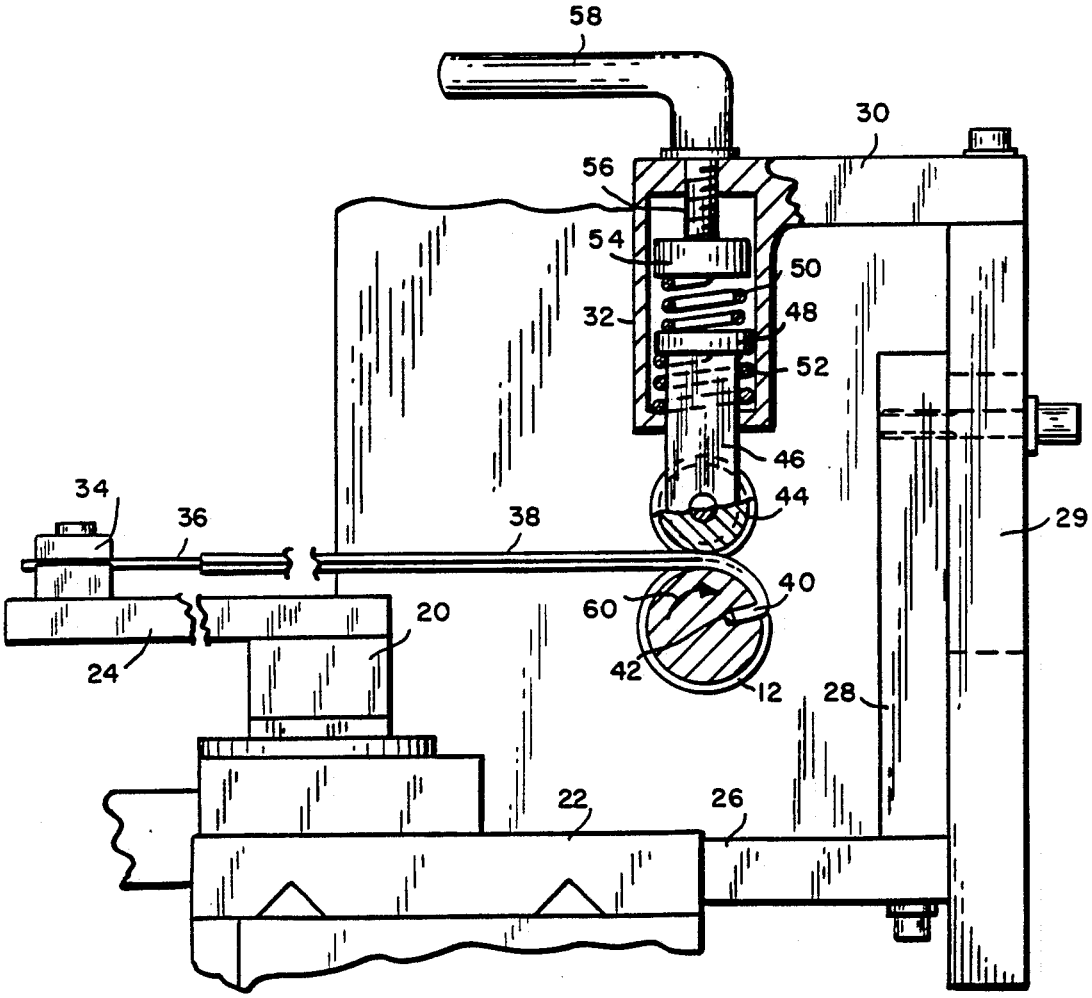
FIG. 2 is a cross sectional view taken through the spindle and looking to the left as viewed in FIG. 1, with portions of selected components broken away.
Figure 3:
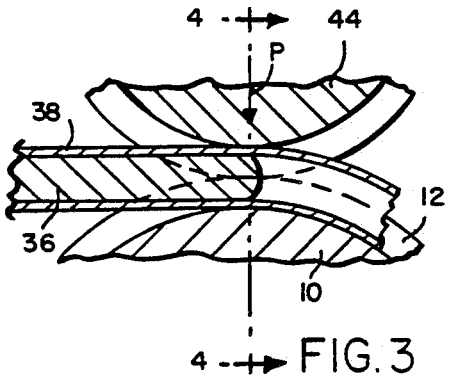
FIG. 3 is an enlarged cross sectional view showing the tube being bent and pressed into the external spindle groove.
Figure 4:
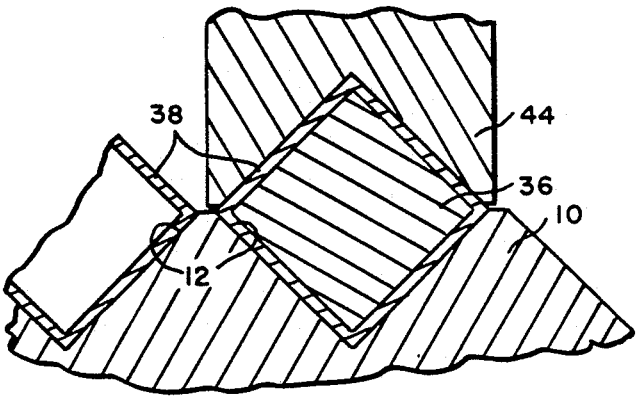
FIG. 4 is a further enlarged sectional view taken along line 4–4 of FIG. 3.

As can best be seen in FIG. 3, the end of the mandrel 36 lies in a plane "P" containing the rotational axes of the roller 44 and spindle 10. When the handle 58 is rotated to an appropriate setting to compress spring 50 and thereby overcome the opposing force of spring 52, the roller 44 is resiliently urged towards the spindle 10 to thereby press the tube 38 into the groove 12. The tube 38 is internally supported by the end of the mandrel 36. As the spindle 10 is rotated in the direction indicated by arrow 60 in FIG. 2, the tube 38 is pulled axially from the mandrel 36 and bent into the groove 12 to form a helix 62 (see FIG. 5). Bending occurs at the plane P, where the tube is continuously contacted by the roller 44 and internally supported by the mandrel 36.

The internal support provided by the mandrel assures that tube bending occurs without wrinkling along the inside diameter of the helix coils. The resilient pressuring action of the roller effects precise and permanent deformation, and thus eliminates any tendency of the thus bent coils to spring back away from the spindle.

The lathe cross slide 22 moves along the axis of the spindle 10 during the bending operation, thereby allowing the mandrel 36 carried by the arm 24 and the spring loaded roller 44 carried by the bracket 30 to track along the spindle groove 12.

Figure 5:
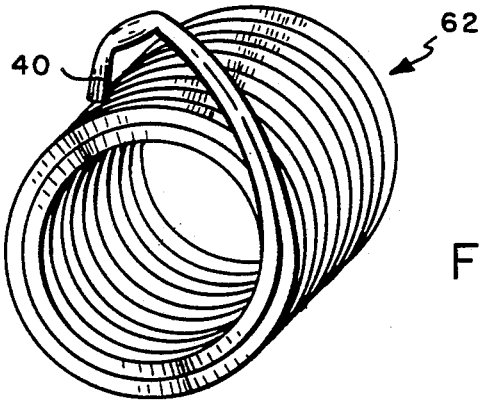
FIG. 5 is a perspective view of a helix produced by the apparatus.

Once the helix 62 is formed, the handle 58 is backed off, thereby allowing the upper spring 50 to expand, with an accompanying expansion of the lower spring 52 which lifts the roller 44 away from the spindle 10. The tail stock 18 is loosened to back its tapered end 16 away from the spindle, and the end 40 of the helix is bent outwardly to remove it from radial opening 42. The spindle is then rotated in the opposite direction, thus causing the helix to be "unscrewed" and removed axially from the spindle. The resulting product is shown in FIG. 5. It is characterized by a smooth wrinkle free surface, and is free of sand or other internal contaminants.

While the invention has been described and illustrated in connection with the bending of a tube having a straight sided rectangular cross sectional configuration, it will be understood that other shapes, e.g., ovals, circles, etc. can be handled in the same way by simply changing the mandrel 36 and groove configuration on the spindle 10 to accommodate the shape being processed.

I claim:

1. Apparatus for forming an elongated tubular element into a helix, said apparatus comprising:

a spindle rotatable about a first axis;

means defining a spiral groove on the exterior of said spindle;

means including a mandrel onto which said element is axially inserted for axially guiding said element to said groove;

means for detachably connecting an end of said element to said spindle;

means for rotating said spindle about said first axis thereby to axially withdraw said element from an end of said mandrel and to wind and permanently deform said element around said spindle and into said groove; and means including a roller for laterally pressing said element into said groove, said roller being rotatable about a second axis and said first and second axes and said end of said mandrel being arranged in a common plane.

2. The apparatus as claimed in claim 1 wherein said spiral groove is in the form of a screw thread.

3. The apparatus as claimed in claim 1 wherein the means for detachably connecting an end of the element to the spindle is comprised of opening in said spindle, said opening extending radially inwardly from said groove and being configured and dimensioned to receive said end.

4. The apparatus as claimed in claim 1 wherein the means for laterally pressing said element into said groove comprises a roller.

5. The apparatus as claimed in claim 4 wherein said roller is rotatable about an axis parallel to the rotational axis of said spindle.

6. The apparatus as claimed in claim 1 wherein said roller is peripherally grooved to accommodate the cross-sectional configuration of said element.

7. The apparatus as claimed in claim 1 wherein said roller is resiliently urged towards said spindle.

8. The apparatus as claimed in claim 1 further comprising means for shifting said roller along the axis of said spindle to maintain said roller in contact with said element as said element is wound into said groove.

9. The apparatus as claimed in claim 1 further comprising means for axially guiding said element onto said spindle.

10. The apparatus as claimed in claim 1 wherein said means for axially guiding said element is arranged to direct said element between said spindle and said means for laterally pressing said element into said groove.

11. The apparatus as claimed in claim 10 wherein said means for axially guiding said element and said means for laterally pressing said element are mounted on a common carrier.

12. The apparatus as claimed in claim 11 further comprising means for moving said carrier in a direction parallel to the axis of said spindle.

13. The apparatus as claimed in claim 12 wherein the bending of said element into said helix occurs at a reference plane containing the axis of said spindle, and wherein said means for laterally pressing said element into said groove is in continuous contact with said element along said plane.

14. The apparatus as claimed in claim 13 further comprising carrier means for supporting said means for laterally pressing said element, and means for moving said carrier means in a direction parallel to the axis of said spindle.

15. The apparatus as claimed in claim 14 wherein said means for laterally pressing said element into said groove comprises a roller rotatable about an axis parallel to the axis of said spindle, and wherein said carrier includes means for urging said roller towards said spindle.

16. The apparatus as claimed in claim 9 wherein said means for axially guiding said element comprises a mandrel onto which said element is axially received.

17. The apparatus as claimed in claim 1 further comprising means for varying the force exerted by said means for pressing said element into said groove.

* * * * *